US012138741B2

(12) United States Patent
Sun et al.

(10) Patent No.: US 12,138,741 B2
(45) Date of Patent: Nov. 12, 2024

(54) POLISHING FLUID COLLECTION APPARATUS AND METHODS RELATED THERETO

(71) Applicant: Applied Materials, Inc., Santa Clara, CA (US)

(72) Inventors: Lizhong Sun, San Jose, CA (US); Peng Liu, Xi'an (CN); Jianjun Hu, Xi'an (CN)

(73) Assignee: Applied Materials, Inc., Santa Clara, CA (US)

( * ) Notice: Subject to any disclaimer, the term of this patent is extended or adjusted under 35 U.S.C. 154(b) by 505 days.

(21) Appl. No.: 17/430,688

(22) PCT Filed: Apr. 4, 2019

(86) PCT No.: PCT/CN2019/081499
§ 371 (c)(1),
(2) Date: Aug. 12, 2021

(87) PCT Pub. No.: WO2020/199193
PCT Pub. Date: Oct. 8, 2020

(65) Prior Publication Data

US 2022/0193863 A1 Jun. 23, 2022

(51) Int. Cl.
*B24B 55/12* (2006.01)
*B24B 37/00* (2012.01)
*B24B 57/02* (2006.01)

(52) U.S. Cl.
CPC ..... *B24B 55/12* (2013.01); *B24B 37/00* (2013.01); *B24B 57/02* (2013.01)

(58) Field of Classification Search
CPC ..... B24B 57/00; B24B 57/02; B24B 37/10; B24B 37/07; B24B 37/107; B24B 37/015; B24B 37/005
See application file for complete search history.

(56) References Cited

U.S. PATENT DOCUMENTS 5,738,574 A * 4/1998 Tolles ..... B24B 53/017 451/247
6,291,350 B1 * 9/2001 Hashimoto ..... B24B 37/04 438/692

(Continued)

FOREIGN PATENT DOCUMENTS

CN 101579833 A 11/2009
CN 204868565 U 12/2015
CN 108527130 A 9/2018

OTHER PUBLICATIONS

International Search Report and Written Opinion dated Dec. 31, 2019 for PCT/CN2019/081499.

(Continued)

*Primary Examiner* — Joel D Crandall
(74) *Attorney, Agent, or Firm* — Patterson + Sheridan, LLP

(57) ABSTRACT

Embodiments of the present disclosure generally provide apparatus for collecting and reuse polishing fluids and methods related thereto. In particular, the apparatus and methods provided herein feature a polishing fluid collection system used to collect and reuse polishing fluids dispensed during the chemical mechanical polishing (CMP) of a substrate in an electronic device manufacturing process. In one embodiment, a polishing fluid catch basin assembly includes a catch basin sized to surround at least a portion of a polishing platen and to be spaced apart therefrom. The catch basin features an outer wall, an inner wall disposed radially inward of the outer wall, and a base portion connecting the inner wall to the outer wall. The outer wall, the inner wall, and the base portion collectively define a trough. A radially inward facing surface of the inner wall is defined by an arc radius which is greater than a radius of the polishing platen the catch basin is sized to surround.

13 Claims, 4 Drawing Sheets

(56) References Cited

U.S. PATENT DOCUMENTS

| | | | | |
|---|---|---|---|---|
| 6,558,238 | B1 | 5/2003 | Crevasse et al. | |
| 6,585,876 | B2 * | 7/2003 | Dordi | C25D 17/008 204/224 R |
| 7,137,879 | B2 | 11/2006 | Chen et al. | |
| 7,238,090 | B2 | 7/2007 | Tolles et al. | |
| 7,418,978 | B2 | 9/2008 | Chao et al. | |
| 7,947,170 | B2 | 5/2011 | Golden et al. | |
| 8,578,953 | B2 | 11/2013 | Takiguchi et al. | |
| 8,739,806 | B2 * | 6/2014 | Liu | H01L 21/02052 134/104.2 |
| 9,339,914 | B2 | 5/2016 | Yavelberg | |
| 2001/0003700 | A1 | 6/2001 | Mizuno et al. | |
| 2003/0164356 | A1 | 9/2003 | Tanaka et al. | |
| 2004/0163946 | A1 | 8/2004 | Chang et al. | |
| 2007/0298692 | A1 | 12/2007 | Mavliev et al. | |
| 2011/0240220 | A1 | 10/2011 | Schoeb | |
| 2013/0291444 | A1 | 11/2013 | Matsuo et al. | |
| 2014/0069890 | A1 | 3/2014 | Yavelberg | |
| 2018/0339399 | A1 | 11/2018 | Inui et al. | |
| 2020/0043748 | A1 | 2/2020 | Liu | |

OTHER PUBLICATIONS

Chinese Office Action for Application No. 201980097232.4 dated Sep. 2, 2022.

* cited by examiner

POLISHING FLUID COLLECTION APPARATUS AND METHODS RELATED THERETO

BACKGROUND

Field

Embodiments described herein generally relate to methods and apparatus used to collect and reuse polishing fluids, and more particularly, to methods and apparatus used to collect polishing fluids used during a chemical mechanical polishing (CMP) process for the fabrication of electronic devices for the reuse thereof.

Description of the Related Art

Chemical mechanical polishing (CMP) is commonly used in the manufacturing of high-density integrated circuits, e.g., semiconductor devices, to planarize or polish a layer of material deposited on a substrate. A typical CMP process includes contacting the material layer of the substrate to be planarized with a polishing pad and moving the polishing pad, the substrate, or both, and hence creating relative movement between the material layer surface and the polishing pad, in the presence of a polishing fluid. Material is removed across the material layer surface in contact with the polishing pad through a combination of chemical and mechanical activity, which is provided at least in part by the polishing fluid. Commonly used polishing fluids include abrasive particle containing slurries, e.g., colloids or suspensions, reactive liquid (abrasive-free) slurries, and abrasive-free or reduced-abrasive polishing fluids used in conjunction with fixed abrasive polishing pads having abrasive particles disposed therein.

Often, the one or both of the polishing fluid and the abrasive particles contained therein are highly engineered to provide desired chemical and mechanical polishing performance characteristics and to disperse and keep the abrasive particles in a colloid or a relatively stable suspension. At least in part due to the high costs of engineering and manufacturing CMP polishing fluids, the cost of CMP polishing fluid per substrate polishing process results in CMP processes often being the most expensive substrate processing operations in the manufacturing of semiconductor devices.

Accordingly, in order to reduce costs associated with CMP polishing fluids there is a need in the art for methods of collecting and reuse CMP polishing fluids and apparatus related thereto.

SUMMARY

The present disclosure generally relates to methods and apparatus used to collect and reuse polishing fluids used during a chemical mechanical polishing (CMP) process for the fabrication of electronic devices In one embodiment, a polishing fluid catch basin assembly includes a catch basin sized to surround at least a portion of a polishing platen and to be spaced apart therefrom. The catch basins features an inner wall, an outer wall disposed radially outward from the inner wall, the outer wall having a plurality of openings disposed therethrough, and a base portion connecting the inner wall to the outer wall. The outer wall, the inner wall, and the base portion collectively define a trough. Here, a radially inward facing surface of the inner wall is defined by an arc radius with is greater than a radius of the polishing platen the catch basin is sized to surround. The plurality of openings are formed in a portion of the outer which extends further from the base portion than an upper surface of the inner wall.

In another embodiment, a polishing fluid catch basin assembly includes a catch basin sized to surround at least a portion of a polishing platen and to be spaced apart therefrom. The catch basin features an outer wall, an inner wall disposed radially inward of the outer wall, and a base portion connecting the inner wall to the outer wall. The outer wall, the inner wall, and the base portion collectively define a trough and a radially inward facing surface of the inner wall is defined by an arc radius which is greater than a radius of the polishing platen the catch basin is sized to surround. The outer wall has a plurality of openings disposed therethrough. Here, individual ones the plurality of openings are sized to receive a respective nozzle of a plurality of nozzles. The openings are positioned in a portion of the outer wall which will be disposed beneath a plane of an upper surface of the polishing platen or a polishing pad mounted on the polishing platen when the catch basin is mounted on a polishing system.

In another embodiment, a polishing system includes a rotatable polishing platen having a drainage basin at least partially disposed there beneath, a substrate carrier disposed above the polishing platen and facing there towards and a polishing fluid catch basin assembly. The polishing fluid catch basin assembly includes a fluid catch basin sized to surround at least a portion of the polishing platen and to be spaced apart therefrom by a gap which allows the polishing platen to move relative thereto. The fluid catch basin features an outer wall, an inner wall disposed radially inward of the outer wall, and a base portion connecting the inner wall to the outer wall, where the outer wall, the inner wall, and the base portion collectively define a trough.

In another embodiment, a method of polishing a substrate includes dispensing a polishing fluid onto a surface of a polishing pad, urging the substrate against the surface of the polishing pad while rotating a polishing platen, the polishing platen having the polishing pad disposed thereon, collecting the polishing fluid using a polishing fluid collection and reuse system, and dispensing the polishing fluid collected using the polishing fluid collection and reuse system onto the surface of the polishing pad. Here, the polishing fluid collection and reuse system includes a fluid catch basin disposed about at least a portion of the polishing platen, the fluid catch basin is spaced apart from the polishing platen by a gap to allow the polishing platen to move relative thereto, at least some of the polishing fluid dispensed onto the polishing pad is collected in a trough of the fluid catch basin, and polishing fluid which is not collected into the fluid catch basin flows through the gap into a drainage basin disposed therebeneath.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure generally provide apparatus for collecting and reusing polishing fluids, and methods related thereto. In particular, the apparatus and methods provided herein feature a polishing fluid collection system used to collect, and reuse, polishing fluids dispensed during the chemical mechanical polishing (CMP) of a substrate in an electronic device manufacturing process.

During a typical CMP process, a polishing platen, having a polishing pad mounted thereon, is rotated while a polishing fluid is dispensed onto the surface of the polishing pad and a substrate is urged against the polishing pad in the presence of the polishing fluid. The dispensed polishing fluid is distributed radially outwardly from one or more dispense locations by the centrifugal force imparted to the polishing fluid from the rotating polishing pad. Typically, when the polishing fluid reaches the circumferential edge of the polishing pad the polishing fluid will flow off of the polishing pad and into a drainage basin disposed there beneath. The drainage basin surrounds the polishing platen and extends into a region disposed below the polishing platen to facilitate capture of all of the fluids and other processing byproducts used during a CMP substrate process and other processing activities concomitant therewith, e.g., pad rinsing and pad conditioning activities. The resulting effluent from the drainage basin thus comprises diluted and contaminated polishing fluid which is generally unsuitable for reuse and reuse. Therefore, embodiments herein provide for a polishing fluid capture system for capturing polishing fluid before the fluid would otherwise flow into the drainage basin, thus avoiding any contamination and dilution thereof.

The polishing fluid capture system hereof, in one aspect, comprises a catch basin disposed proximate to the rotatable polishing platen. The catch basin features a trough which has a substantially reduced surface area to polishing fluid volume capacity ratio when compared to the prior drainage basin. Typically, the catch basin is spaced apart from the polishing platen so that the platen may move (rotate about a center plate axis) relative to the catch basin while the catch basin remains in a fixed position. The catch basin features a plurality of nozzles which are fluidly coupled to a vacuum source, such as one or more dedicated vacuum pumps. Vacuum provided through the plurality of nozzles or openings is used to draw the polishing fluid away (radially outwardly) from the sides of the polishing platen, across the gap between the platen and the catch basin, and into the trough. The polishing fluid is drained from the trough through a drain conduit fluidly coupled thereto and is then collected into a storage vessel before delivery to a fluid dispense arm to be dispensed onto the polishing pad during, before, or after CMP processing of the same or a subsequent substrate.

Figure 1:
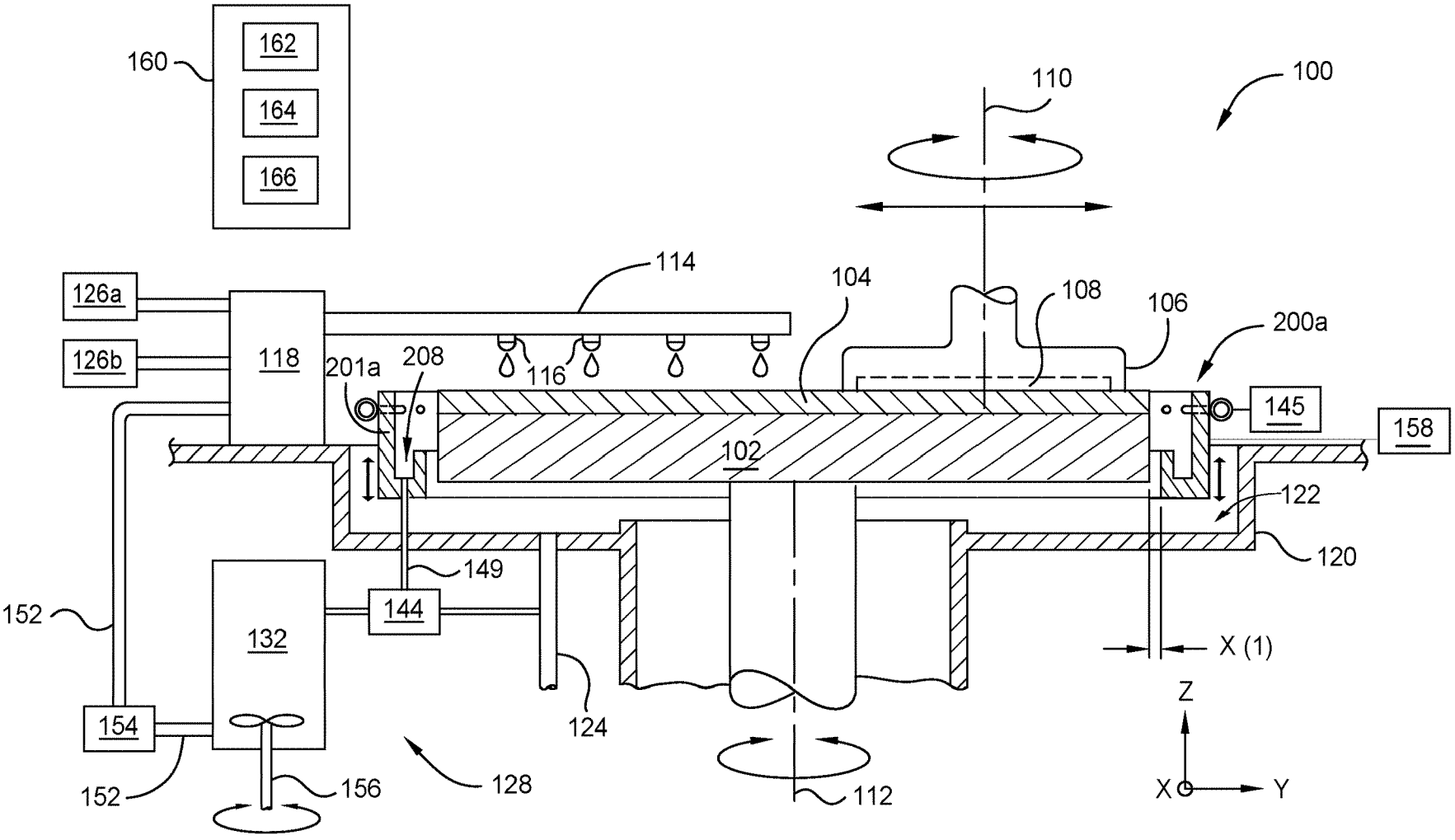
FIG. 1 is a schematic cross sectional view of an exemplary polishing system configured to practice the methods set forth herein, according to some embodiments.

FIG. 1 is a schematic cross sectional view of an exemplary polishing system configured to practice the methods set forth herein, according to one embodiment. Here, the polishing system 100 features a platen 102, having a polishing pad 104 secured thereto using a pressure sensitive adhesive, and a substrate carrier 106 disposed above the platen 102, and thus the polishing pad 104, and facing there towards. The substrate carrier 106 is used to urge a material surface of a substrate 108, disposed therein, against a polishing surface of the polishing pad 104 while simultaneously rotating about a carrier axis 110. Typically, the platen 102 rotates about a platen axis 112 while the rotating substrate carrier 106 sweeps back and forth from an inner diameter to an outer diameter of the platen 102 to, in part, reduce uneven wear of the polishing pad 104. Often, the polishing system 100 further includes a pad conditioner assembly (not shown). The pad conditioner assembly is used to condition the polishing pad 104 by urging a fixed abrasive conditioning disk (not shown) against the surface of the polishing pad 104 before, after, or during polishing of the substrate 108. The conditioning disk is used to abrade, rejuvenate, and remove polish byproducts or other debris from, the polishing surface of the polishing pad 104.

Typically, one or more polishing fluids are delivered to the surface of the polishing pad 104 using a fluid dispense arm 114 positioned there over. The fluid dispense arm 114 dispenses polishing fluid using a one or more or a plurality of dispense nozzles 116. Examples of suitable dispense nozzles include drip nozzles, spray nozzles, or a combination thereof. Here, the fluid dispense arm 114 is coupled to an actuator 118 which positions the fluid dispense arm 114 above the polishing pad by swinging the fluid dispense arm 114 thereover and lowering the fluid dispense arm 114 there towards. The actuator 118 is disposed on, or through, a base plate 120 surrounding the polishing platen 102 where at least a portion of the base plate 120 defines a drainage basin 122 having a first drain conduit 124 disposed through an opening formed in the base thereof. Here, polishing fluids, polishing fluid additives, cleaning fluids, deionized water, and combinations thereof are delivered to the fluid dispense arm 114 from one or more fluid sources 126A-B fluidly coupled thereto.

Herein, the polishing system 100 further includes a fluid collection and reuse system 128. The fluid collection and reuse system 128 features a fluid catch basin assembly 200*a* and a storage vessel 132 fluidly coupled thereto. The catch basin assembly 200*a* includes a catch basin 201*a* disposed about a circumference of the platen 102 and spaced apart therefrom by a distance X(1) to define a gap disposed therebetween. Typically, the catch basin 201*a* is disposed in a fixed in relationship to the base plate 120 and is fixedly coupled thereto by using one or more brackets or other suitable fastener assemblies. The catch basin 201*a* is spaced apart from the platen 102 to allow the platen 102 to move relative thereto as the platen rotates about the platen axis 112. Here, an inner wall of the catch basin 201*a* is separated from the outside wall of the platen 102 by the distance X(1) of about 5 cm or less, such as about 4 cm or less, about 3 cm or less, about 2 cm or less, about 1 cm or less, or for example about 0.5 cm or less. In some embodiments, the catch basin 201*a* is spaced apart from a bottom surface of the drainage basin 122 to allow fluids to freely flow therebetween.

The catch basin 201*a* collects fluid which is spun radially outward from the rotating polishing platen 102 due to the centrifugal force imparted thereto. In some embodiments, the catch basin 201*a* further includes a plurality of vacuum nozzles 210 which are shown and further described in FIG. 2A. The plurality of vacuum nozzles 210 fluidly coupled to a vacuum source 145, such as a dedicated vacuum pump, which provides a vacuum thereto. The vacuum is used to draw fluids radially outward from the polishing platen 102 towards the catch basin 201*a* where the fluid is collected into a fluid collection trough 208 thereof.

From the fluid collection trough 208 the polishing fluid flows through an opening 214 (shown in FIG. 2A) disposed through a bottom of the fluid collection trough 208 and into a drain conduit 149 fluidly coupled thereto. The fluid is then directed towards one of the storage vessel 132 or the drain 124 using a three-way valve 144 fluidly coupled therebetween. Here, the three-way valve is controlled by a system controller 160 and used to direct fluids to the storage vessel or the drain based on the concurrent substrate processing operation and the fluids being used therewith.

For example, polishing fluids collected during polishing of the substrate are directed toward the storage vessel 132 while undesirable fluids or dilute polishing fluid collected during a CMP pad conditioning or pad rinsing operation are directed to the drain 124. Thus, polishing fluid directed towards the storage vessel can be relativity free of contamination or dilution and beneficially suitable for reuse, e.g., substrate polishing, without further processing. From the storage vessel 132 the polishing fluid is delivered to the fluid dispense arm 114 using a suitable pump 154, e.g., a peristaltic pump, to be dispensed onto the polishing pad 104 and thus reused in the same or a subsequent substrate CMP process. In some embodiments, the storage vessel includes a mixer 156 which is used to mechanically agitate the polishing fluid to help keep abrasive particles of the polishing fluid in suspension. In some embodiments, such as where one or more reactive components of the polishing fluid is depleted during the polishing process, polishing fluid from one or more of the fluid source, i.e., fresh polishing fluid, is delivered to the storage vessel 132 to be mixed with the polishing fluid collected from the catch basin 201*a*.

In some embodiments, the catch basin assembly 200*a* is coupled to a Z-actuator 158 which is configured to raise and lower the catch basin assembly 200*a* in the Z-direction. In those embodiments, the catch basin assembly 200*a* is raised when fluid which is undesirable for reuse is dispensed onto the polishing pad. In the raised position a radially inward facing surface of the inner wall 202 of the catch basin 201*a* (described in FIG. 2A) obstructs fluid flowing off of the edge of the polishing pad from entering a trough 208 (described in FIG. 2A) of the catch basin 201*a*. Thus, the fluid which is undesirable for reuse flows through a gap defined by the radially inward facing surface of the inner wall and the sides of the polishing platen 102 into the drainage basin 122 disposed there below. When polishing fluid desired for reuse is dispensed onto the polishing pad 104 the catch basin assembly 200*a* is lowered into a fluid collection position and the desired polishing fluid for reuse is collected using the methods described herein.

Here, the polishing system 100 further includes a system controller 160 to direct the operation thereof, which includes direction the operation of the fluid collection and reuse system 128. The system controller 160 includes a programmable central processing unit, such as the CPU 162, which is operable with a memory 164 (e.g., non-volatile memory) and support circuits 166. The support circuits 166 are conventionally coupled to the CPU 162 and comprise cache, clock circuits, input/output subsystems, power supplies, and the like, and combinations thereof coupled to the various components of the polishing system 100, to facilitate control thereof. The CPU 162 is one of any form of general purpose computer processor used in an industrial setting, such as a programmable logic controller (PLC), for controlling various components and sub-processors of the polishing system 100. The memory 164, coupled to the CPU 162, is non-transitory and is typically one or more of readily available memories such as random access memory (RAM), read only memory (ROM), floppy disk drive, hard disk, or any other form of digital storage, local or remote.

Typically, the memory 164 is in the form of a computer-readable storage media containing instructions (e.g., non-volatile memory), which when executed by the CPU 162, facilitates the operation of the polishing system 100. The instructions in the memory 164 are in the form of a program product such as a program that implements the methods of the present disclosure.

The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure. In some embodiments, the methods set forth herein, or portions thereof, are performed by one or more application specific integrated circuits (ASICs), field-programmable gate arrays (FPGAs), or other types of hardware implementations. In some other embodiments, the polishing pad manufacturing methods set forth herein are performed by a combination of software routines, ASIC(s), FPGAs and, or, other types of hardware implementations.

Figure 2A:
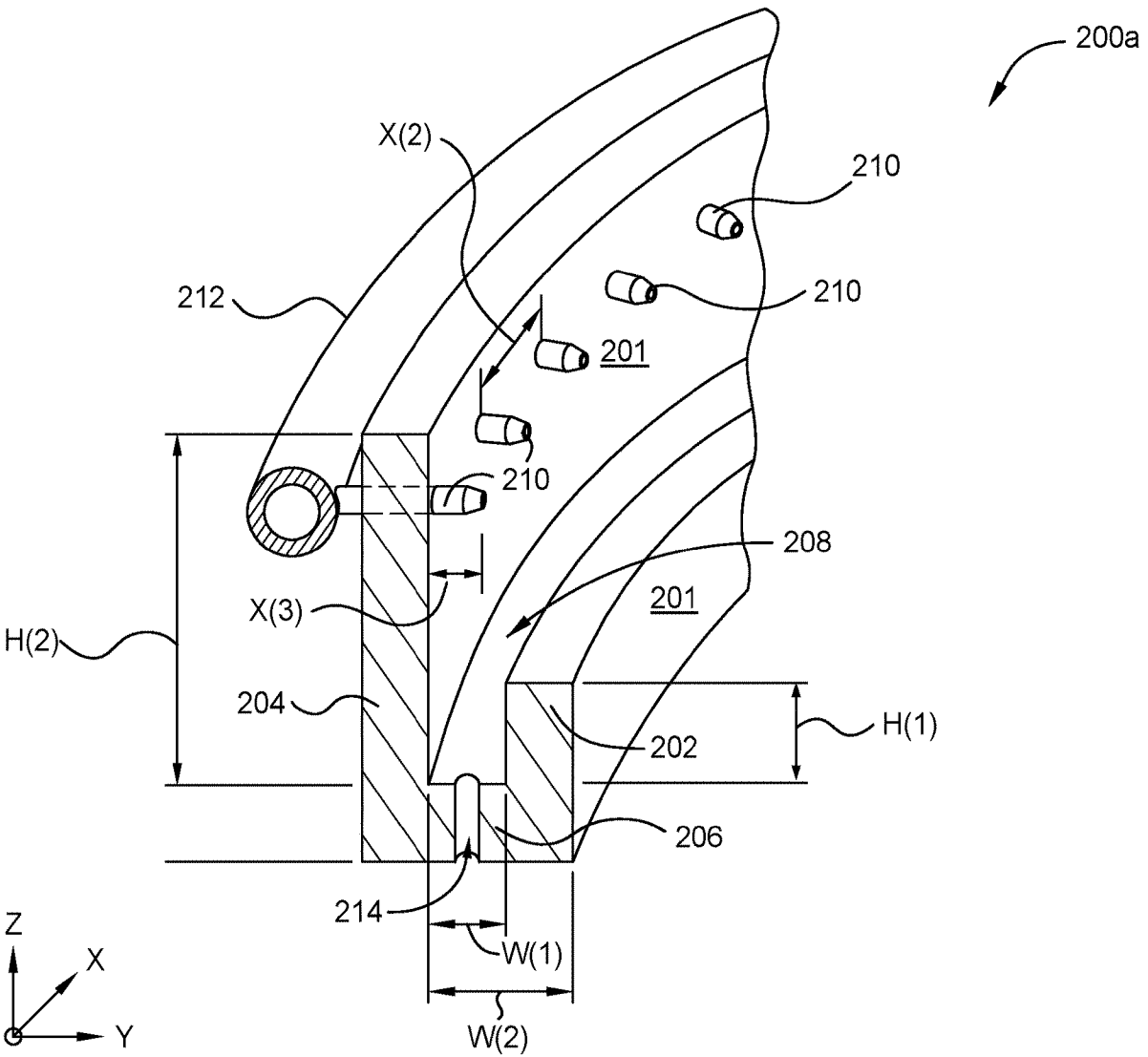
FIG. 2A is a schematic isometric sectional view of a portion of a fluid catch basin assembly used with the polishing system described in FIG. 1, according to one embodiment.

FIG. 2A is a schematic isometric sectional view of a portion of a fluid catch basin assembly 200*a* which may be used with the polishing system described in FIG. 1, according to one embodiment. Here, the catch basin assembly 200*a* includes a catch basin 201*a*, a plurality of nozzles 210, and a vacuum line 212 to be used to fluidly couple the plurality of nozzles 210 to a vacuum source, such as the vacuum source 145 described in FIG. 1. Typically, the catch basin 201*a* is formed of a polishing fluid chemically resistant polymer having a hydrophobic surface. Examples of suitable polymers include fluorine-containing polymers (fluoropolymers), such as perfluoroalkoxy (PFA), fluorinated ethylene propylene (FEP), polytetrafluoroethylene (PTFE) commercially available as TEFLON® from DuPont, or combinations thereof.

Here, the catch basin 201*a* forms an annular ring and is sized to surround a polishing platen of a polishing system, such as the polishing platen 102 described in FIG. 1, and to be spaced apart therefrom by the distance X(1) described above. The catch basin 201*a* features an inner wall 202, an outer wall 204 disposed radially outward of the inner wall, and a base portion 206 connecting the inner wall 202 to the outer wall 204. The inner wall 202, the outer wall 204, and the base portion 206 collectivity define a trough 208. For example, here the inner wall 202, the outer wall 204, and the base portion form generally U-shaped channel although any suitable cross-sectional shape may be used. The trough 208 is used to collect polishing fluid and to direct the collected polishing fluid to an opening 214 disposed through the base portion 206. The outer wall 204 is spaced apart from the inner wall 202 by the width W(1) of the trough 208 which is between about 1 cm and about 10 cm. A combined width W(2) of the trough 208 and the thickness of the inner wall 202 is between about 2 cm and about 11 cm.

Thus, when the catch basin assembly 200*a* is mounted on a polishing system, the radially inward facing surface of the outer wall 204 is spaced apart from the polishing platen thereof by the combined distance of X(1) and W(2), such as about 2.5 cm or less, 2 cm or less, 1.5 cm or less, 1.0 cm or less, 0.8 cm or less, for example about 0.7 cm or less. In some embodiments the trough facing surface of the base portion 206 is sloped towards the opening 214 (when the catch basin assembly is mounted on a polishing system) to facilitate the gravity assisted flow of polishing fluid thereinto.

The inner wall 202 extends from the base portion 206 in the Z-direction by a height H(1) and the outer wall 204 extends from the base portion 206 in the Z-direction by a height H(2). Here, the Z-direction is orthogonal to the polishing pad mounting surface of a polishing platen 102 when the catch basin assembly 200*a* is mounted on a polishing system, such as the polishing system 100 described with respect to FIG. 1. Typically, the height H(2) of the outer wall is between about 5 cm and about 15 cm and a ratio of the height H(1) of the inner wall 202 to the height H(2) of the outer wall is between about 1:4 and about 2:3, such as between about 1:4 and about 1:2. Here, the outer wall 204 has a plurality of openings disposed thereto which are sized to respectively receive a corresponding nozzle 210 of a plurality of nozzles 210. The plurality of nozzles 210 are disposed through the outer wall 204 to face the sides of a polishing platen or a polishing pad mounted on a polishing platen when the catch basin assembly 200*a* is mounted on a polishing system. When the catch basin assembly 200*a* is mounted on a polishing system the plurality of nozzles 210, and thus the plurality of the openings, are disposed beneath a plane of the polishing surface of the polishing pad to face the sides of the polishing pad or the sides of the polishing platen disposed therebeneath. Typically, individual ones of the plurality of nozzles 210 are disposed through a portion of the outer wall 204 which extends further in the Z-direction from the base 206 than does the inner wall 202. Thus, the vacuum used to draw the polishing fluid away from the sides of the polishing platen is not obstructed from the side of the polishing pad 104 or platen 102 by the inner wall 202.

Here, adjacently disposed nozzles are circumferentially spaced apart by a distance of X(2), measured along an inner circumferential surface of the outer wall 204, and each extends radially inwardly from the inner circumferential surface of the outer wall by a distance of X(3). For example, in some embodiments, adjacently disposed nozzles are spaced apart by the distance X(2) of about 50 cm or less, such as about 15 cm or less, about 10 cm or lessor for example about 5 cm or less. In some embodiments, individual ones of the plurality of nozzles 210 extend radially inward from the outer wall toward the platen 102 or polishing pad 104 by a distance X(3) of about 0 cm or more, 0.5 cm or more, for example 1 cm or more. In some embodiments, when the catch basin assembly 200*a* is mounted on a polishing system, individual ones of the plurality of nozzles 210 are spaced apart from the sides of the polishing pad or polishing platen by a distance of about 10 cm or less, such as about 5 cm or less, 4 cm or less, 3 cm or less, or for example 2 cm or less.

Figure 2B:
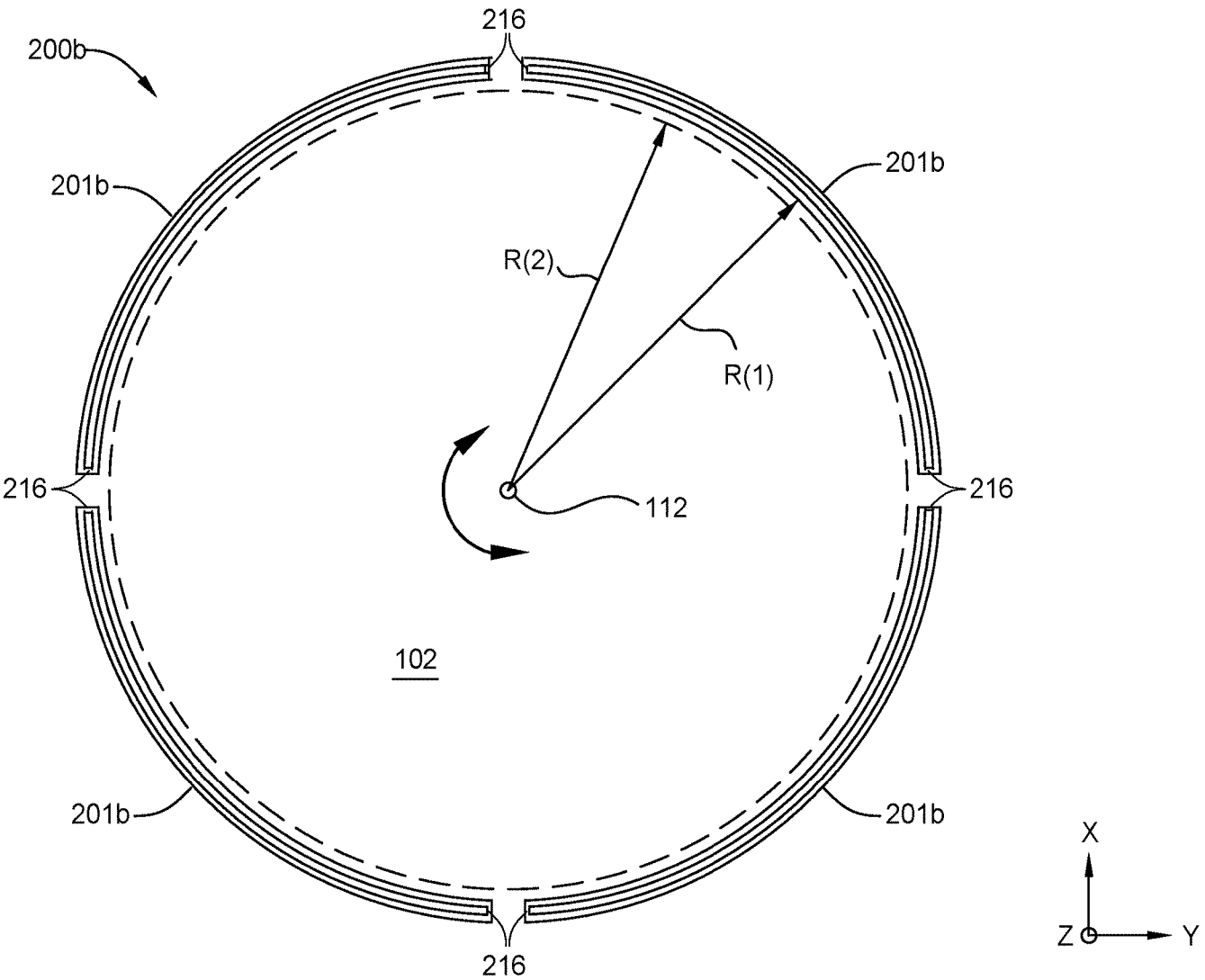
FIG. 2B is a plan view schematically illustrating a plurality of fluid catch basin segments which may be used with the polishing system described in FIG. 1, according to another embodiment.

FIG. 2B is a plan view schematically illustrating another embodiment of a fluid catch basin assembly which may be used with the polishing system described in FIG. 1, according to another embodiment. Here, the annular catch basin 201*a* of FIG. 2A has been segmented into one or more catch basins 201*b* each having the features of the catch basin 201*a* shown and described in FIG. 2A and each forming an arced segment to be disposed about a portion of a polishing platen 102. For example, each of the one or more catch basins 201*b* features an inner wall 202, an outer wall 204 disposed radially outward of the inner wall, and a base portion 206 connecting the inner wall 202 to the outer wall 204 as shown and described in FIG. 2A. Here, the inner arc radius R(1) defining the inner surface of the inner wall 202 of the one or more catch basins 201*b* is about 10 cm or more, such as about 5 cm or more, about 4 cm or more, about 3 cm or more, about 2 cm or more, about 1 cm or more, or for example, about 1 mm or more greater than the radius R(2) of a polishing platen 102 (shown in phantom) of a polishing system to have the catch basin assembly 200*b* is mounted thereon. The difference between R(2) and R(1) is the distance X(1) described above.

For each of the one or more catch basins 201*b* the inner wall 202, the outer wall 204, and the base portion 206 collectivity define trough 208 for collecting polishing fluid. The collected polishing fluid is then drained from the trough 208 through an opening 214 formed through the base portion 206, as shown and described in FIG. 2A. Here, each of the one or more catch basins 201*b* further includes two end walls 216 disposed at opposing ends of the trough 208. Each of the end walls 216 extend upwardly (in the Z direction) from the base portion 206 to connect the end of the inner wall 202 to the end of the outer wall 204 which prevent polishing flowing out from the trough 208 and into a drainage basin disposed therebeneath. Typically, when mounted on a polishing system, the opening(s) 214 of the one or more catch basins 201*b* are fluidly coupled by one or more respective drain conduits 149 each in fluid communication which each other and with the three-way valve 144.

In some embodiments, the catch basin assembly 200*b* further includes a plurality of nozzles 210 disposed through the outer wall 204 of the one or more catch basins 201*b* and a vacuum line 212 fluidly coupled to the plurality of nozzles, as shown and described in FIG. 2A.

Figure 3:
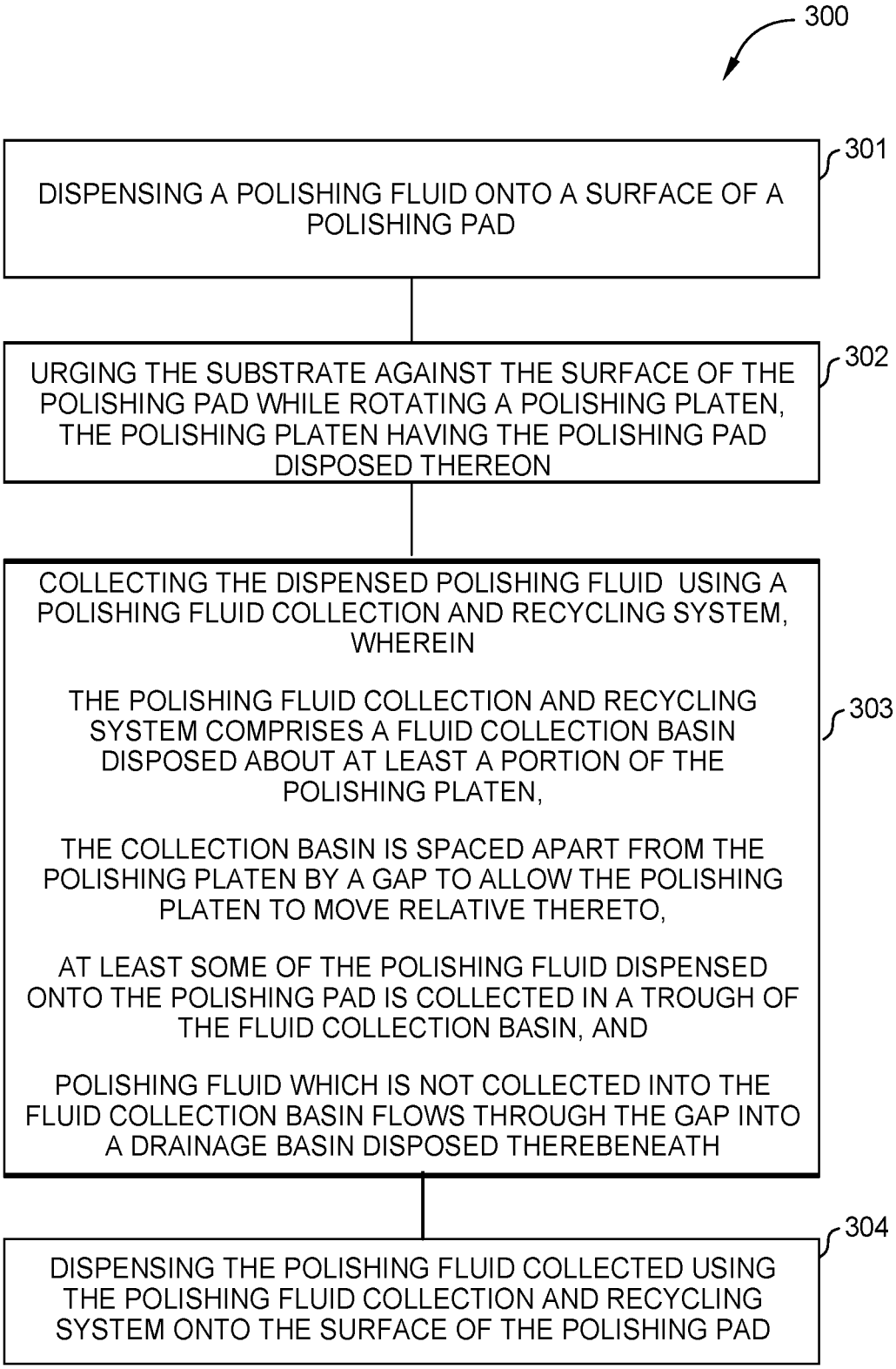
FIG. 3 is a flow diagram setting forth a method of polishing a substrate using the polishing system described in FIG. 1, according to one embodiment.

FIG. 3 is a flow diagram setting forth a method of polishing a substrate using the fluid collection and reuse system 128 described in FIG. 1, according to one or more embodiments. At activity 301 the method 300 includes dispensing a polishing fluid onto a polishing surface of a polishing pad. Here the polishing pad is disposed on a surface of a polishing platen, such as the polishing platen of the polishing system described in FIG. 1. Typically, the polishing fluid is dispensed onto the polishing pad using a fluid delivery arm positioned thereabove. Here, the dispensed polishing fluid is one or a combination of a polishing fluid delivered from a polishing fluid source coupled to the fluid delivery arm or polishing fluid collected using the fluid collection and reuse system described herein. Typically, the polishing fluid source comprises a centralized or local polishing fluid distribution system used by a manufacturing facility to deliver polishing fluid to the polishing system.

Polishing fluid from the polishing source typically has not yet been used in a substrate CMP processing operation.

At activity 302 the method 300 includes polishing the substrate in the presence of the polishing fluid, i.e., urging the substrate against the polishing pad in the presence of the polishing fluid, to remove material from the surface of the substrate. In some embodiments, the polishing fluid collected using the fluid collection and reuse system and the polishing fluid from the polishing fluid source are sequentially dispensed onto the surface of the polishing pad. For example, in some embodiments, the substrate is first polished using polishing fluid collected using the fluid collection and reuse system before being polished using polishing fluid from the polishing fluid source, or vice versa. For example, in at least one embodiment a substrate is polished using only the polishing fluid collected using the fluid collection and reuse system for a first period time before using being polished for a second period of time using only polishing fluid from the polishing source. The second period of time may be within 80% of the first period of time. Polishing the substrate with only polishing fluid for the polishing source for the second period time ensures that any possible defects to the substrate surface cause by trace contaminants or agglomerations in the polishing fluid collected using the polishing fluid collection and reuse system are removed from the substrate surface.

In some embodiments, dispensing the polishing fluid collected using the fluid collection and reuse system is alternated with dispensing polishing fluid from the polishing fluid source. In some embodiments, polishing fluid from the polishing fluid source is mixed with the polishing fluid collected using the fluid collection and reuse system before being delivered to the polishing surface of the polishing pad.

At activity 303 the method 300 includes collecting the dispensed polishing fluid using the polishing fluid collection and reuse system described herein. Typically, once dispensed onto the surface the polishing pad, polishing fluid flows radially outward from the center of the polishing pad by a centrifugal force imparted thereto from the rotation of the polishing platen. When the polishing fluid exiting the dispensing unit reaches the polishing pad, the fluid, which is on the rotating pad, flows toward the edge of the pad and then outwardly away from the polishing platen into a trough of a catch basin, such as the catch basins 201*a* and 201*b* respectively described in FIGS. 2A and 2B, which is disposed about at least a portion of the polishing platen.

In some embodiments, such as in embodiments where the polishing fluid is too viscous to be spun across the gap disposed between the platen and the catch basin, a vacuum applied through a plurality of nozzles, such as shown and described in FIG. 2A, is used to draw the polishing fluid away from the sides of the polishing pad or the polishing platen across the gap and into the trough of the catch basin. Typically, fluids which are not collected into the fluid catch basin will flow between the polishing platen and the catch basin and into a polishing system drainage basin disposed there beneath. In some embodiments, the vacuum is not applied during periods when undesirable fluids or fluids unsuitable for reuse are flowing from the edges of the polishing pad. For example, in some embodiments, the vacuum is not applied during polishing pad rinse or polishing pad conditioning operations. Toggling the vacuum from on to off depending on the processing operation and the fluid being dispensed therewith prevents or limits collection of undesired dilute or contaminated fluids. Here, the vacuum required to pull the polishing fluid from the sides of the polishing platen depends, inter alia, on the cross sectional area of nozzle opening, the distance between the nozzle and the polishing platen, and the viscosity of the polishing fluid.

From the trough of the catch basin the polishing fluid is directed towards one of a storage vessel or a polishing system drain using a three-way valve fluidly coupled therebetween. Here, an inlet to the three-way valve is further fluidly coupled to an opening formed through a base portion of the catch basin. The three-way valve facilitates the cleaning of the collection basin with rinse water or cleaning fluids and draining of undesirable fluids therefrom without contaminating or diluting the polishing fluid that is directed to the storage vessel. Examples of undesirable fluids collected in the trough of the catch basin include fluids from polishing pad rinse or polishing pad conditioning operations.

Beneficially, the apparatus and methods provided herein facilitate the collection and reuse of expensive CMP polishing fluids without substantial reprocessing thereof.

While the foregoing is directed to embodiments of the present disclosure, other and further embodiments of the disclosure may be devised without departing from the basic scope thereof, and the scope thereof is determined by the claims that follow.

The invention claimed is:

1. A polishing fluid catch basin assembly for a chemical mechanical polishing system, the polishing fluid catch basin assembly comprising:

a catch basin having an annular ring shape and sized to surround a polishing platen of the chemical mechanical polishing system and to be spaced apart therefrom the polishing platen, the catch basin comprising:

an outer wall having a plurality of openings disposed therethrough, wherein individual ones of the plurality of openings are sized to receive a respective nozzle of a plurality of nozzles, and the openings are disposed through a portion of the outer wall which will be beneath a plane of an upper surface of the polishing platen or a polishing pad mounted on the polishing platen when the catch basin is mounted in the chemical mechanical polishing system;

an inner wall disposed radially inward of the outer wall; and a base portion connecting the inner wall to the outer wall, wherein the outer wall, the inner wall, and the base portion collectively define a trough, and a radially inward facing surface of the inner wall is defined by a radius greater than a radius of the polishing platen the catch basin is sized to surround.

2. The polishing fluid catch basin assembly of claim 1, wherein the inner wall is sized to surround the polishing platen of a chemical mechanical polishing system and to be spaced apart therefrom by a gap of about 5 cm or less.

3. The polishing fluid catch basin assembly of claim 1, wherein a height of the inner wall is less than a height of the outer wall.

4. The polishing fluid catch basin assembly of claim 1, wherein trough facing surfaces of the outer wall, the inner wall, and the base portion are hydrophobic.

5. The polishing fluid catch basin assembly of claim 1, further comprising a plurality of vacuum nozzles respectively disposed through the plurality of openings and face inwardly from the outer wall.

6. The polishing fluid catch basin assembly of claim 5, wherein individual ones of the plurality of nozzles are disposed through a portion of the outer wall which extends further in a Z-direction than does the inner wall, the Z-direction is orthogonal to an X-Y plane formed by a pad mounting surface of a polishing platen when the polishing fluid catch basin assembly is mounted on a polishing system.

7. A polishing system, comprising:

a rotatable polishing platen having a drainage basin at least partially disposed there beneath;

a substrate carrier disposed above the polishing platen and facing there towards; and a polishing fluid catch basin assembly comprising a fluid catch basin sized to surround at least a portion of the polishing platen and to be spaced apart therefrom by a gap which allows the polishing platen to move relative thereto, the fluid catch basin comprising:

an outer wall;

a plurality of nozzles disposed through openings formed through the outer wall and facing inwardly therefrom;

an inner wall disposed radially inward of the outer wall; and a base portion connecting the inner wall to the outer wall, wherein the outer wall, the inner wall, and the base portion collectively define a trough.

8. The polishing system of claim 7, wherein the catch basin forms an annular ring sized to surround a polishing platen and to be spaced apart therefrom by a gap of about 5 cm or less.

9. The polishing system of claim 7, further comprising a polishing fluid storage vessel fluidly coupled to the trough through a three way valve disposed therebetween.

10. The polishing system of claim 9, further comprising a computer-readable medium having instructions for a method of polishing a substrate stored thereon, the method comprising:

dispensing a polishing fluid onto a surface of a polishing pad;

urging the substrate against the surface of the polishing pad while rotating the polishing platen, the polishing platen having the polishing pad disposed thereon;

collecting the dispensed polishing fluid using a polishing fluid collection and reuse system, wherein the polishing fluid collection and reuse system comprises the fluid catch basin, and at least some of the polishing fluid dispensed onto the polishing pad is collected in the trough of the fluid catch basin; and dispensing the polishing fluid collected using the polishing fluid collection and reuse system onto the surface of the polishing pad.

11. The polishing system of claim 10, wherein dispensing the polishing fluid onto the surface of the polishing pad comprises dispensing polishing fluid collected using the polishing fluid collection and reuse system before dispensing polishing fluid delivered from a polishing fluid source or vice versa.

12. A method of polishing a substrate, comprising:

dispensing a polishing fluid onto a surface of a polishing pad disposed on a polishing platen of a chemical mechanical polishing system;

urging the substrate against the surface of the polishing pad while rotating the polishing platen;

collecting the polishing fluid using a polishing fluid collection and reuse system, wherein the polishing fluid collection and reuse system comprises a fluid catch basin disposed about the polishing platen, the fluid catch basin having a ring shaped body comprising:

an inner wall sized to circumscribe the polishing platen and spaced apart from the polishing platen by a gap to allow the polishing platen to move relative thereto;

an outer wall circumscribing the inner wall;

a base portion coupling the outer wall to the inner wall and forming a trough; and a plurality of vacuum nozzles disposed through the outer wall and facing inwardly therefrom, wherein at least some of the polishing fluid dispensed onto the polishing pad is collected in the trough of the fluid catch basin by the vacuum nozzles, and polishing fluid which is not collected into the fluid catch basin flows through the gap into a drainage basin disposed there beneath; and dispensing the polishing fluid collected using the polishing fluid collection and reuse system onto the surface of the polishing pad.

13. The method of claim 12, wherein dispensing the polishing fluid onto the surface of the polishing pad comprises dispensing polishing fluid collected using the polishing fluid collection and reuse system before dispensing polishing fluid delivered from a polishing fluid source or vice versa.

* * * * *